US008418599B2

(12) United States Patent
Dreher et al.

(10) Patent No.: US 8,418,599 B2
(45) Date of Patent: Apr. 16, 2013

(54) AXIAL PISTON MACHINE HAVING A RETURN DEVICE

(75) Inventors: Herbert Dreher, Horb (DE); Clemens Krebs, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 761 days.

(21) Appl. No.: 12/598,969

(22) PCT Filed: May 14, 2008

(86) PCT No.: PCT/EP2008/003866

§ 371 (c)(1),
(2), (4) Date: Nov. 5, 2009

(87) PCT Pub. No.: WO2008/138603

PCT Pub. Date: Nov. 20, 2008

(65) Prior Publication Data

US 2010/0132544 A1 Jun. 3, 2010

(30) Foreign Application Priority Data

May 14, 2007 (DE) ..... 10 2007 022 569

(51) Int. Cl.
*F01B 13/04* (2006.01)
*F01B 31/10* (2006.01)

(52) U.S. Cl.
USPC ..... 92/12.2; 92/157; 91/505

(58) Field of Classification Search ..... 92/12.2, 92/71, 157; 91/504, 505, 506
See application file for complete search history.

(56) References Cited

U.S. PATENT DOCUMENTS

| | | | | |
|---|---|---|---|---|
| 3,753,627 | A | 8/1973 | Ward | |
| 5,251,537 | A | 10/1993 | Hoshino et al. | |
| 5,630,352 | A * | 5/1997 | Todd | 92/12.2 |

FOREIGN PATENT DOCUMENTS

| | | | |
|---|---|---|---|
| EP | 0 554 537 | A1 | 8/1993 |
| EP | 0 922 858 | A2 | 6/1999 |
| EP | 1 118 771 | A2 | 7/2001 |
| JP | 2005-320912 | A | 11/2005 |
| WO | WO 2005/064159 | A1 | 7/2005 |

OTHER PUBLICATIONS

Notification of Reason(s) for Refusal dated Nov. 20, 2012 issued in Japanese Patent Application No. 2010-506865 (English language translation only).

* cited by examiner

*Primary Examiner* — Michael Leslie
(74) *Attorney, Agent, or Firm* — Scully, Scott, Murphy & Presser, P.C.

(57) ABSTRACT

An axial piston machine is provided. The pivoting cradle of the axial piston machine has variable tilt. The axial piston machine has at least one adjustment device extending substantially in the longitudinal direction of the axial piston machine. The axial piston machine further has a return element for returning to a position of the pivoting cradle. The return element and the adjustment device are disposed in a plane extending parallel to an axis of rotation of the axial piston machine and perpendicular to a pivoting axis of the pivoting cradle.

8 Claims, 4 Drawing Sheets

AXIAL PISTON MACHINE HAVING A RETURN DEVICE

BACKGROUND

The invention relates to an axial piston machine having an adjustment device and a return device for re-establishing a position of a pivoting cradle.

In returning systems, the position is detected and fed back to the control device frequently in a manner decoupled from the adjustment device for adjusting a tilt of a pivoting cradle in an adjustable axial piston machine. Mostly linear adjustment and feedback members are used for this.

The object of the invention is to create an axial piston machine having a compact adjustment system and integrated return.

SUMMARY

In accordance with the invention, a return element is provided on an adjustment piston of an adjustment device of an axial piston machine, wherein this return element and the adjustment piston are disposed in a plane which extends perpendicular to the pivot axis of the pivoting cradle and parallel to an axis of rotation of the axial piston machine.

BRIEF DESCRIPTION OF THE DRAWINGS

The invention will be explained in detail hereinafter with the aid of the drawing, in which.

DETAILED DESCRIPTION OF EXEMPLARY EMBODIMENTS

Figure 1:
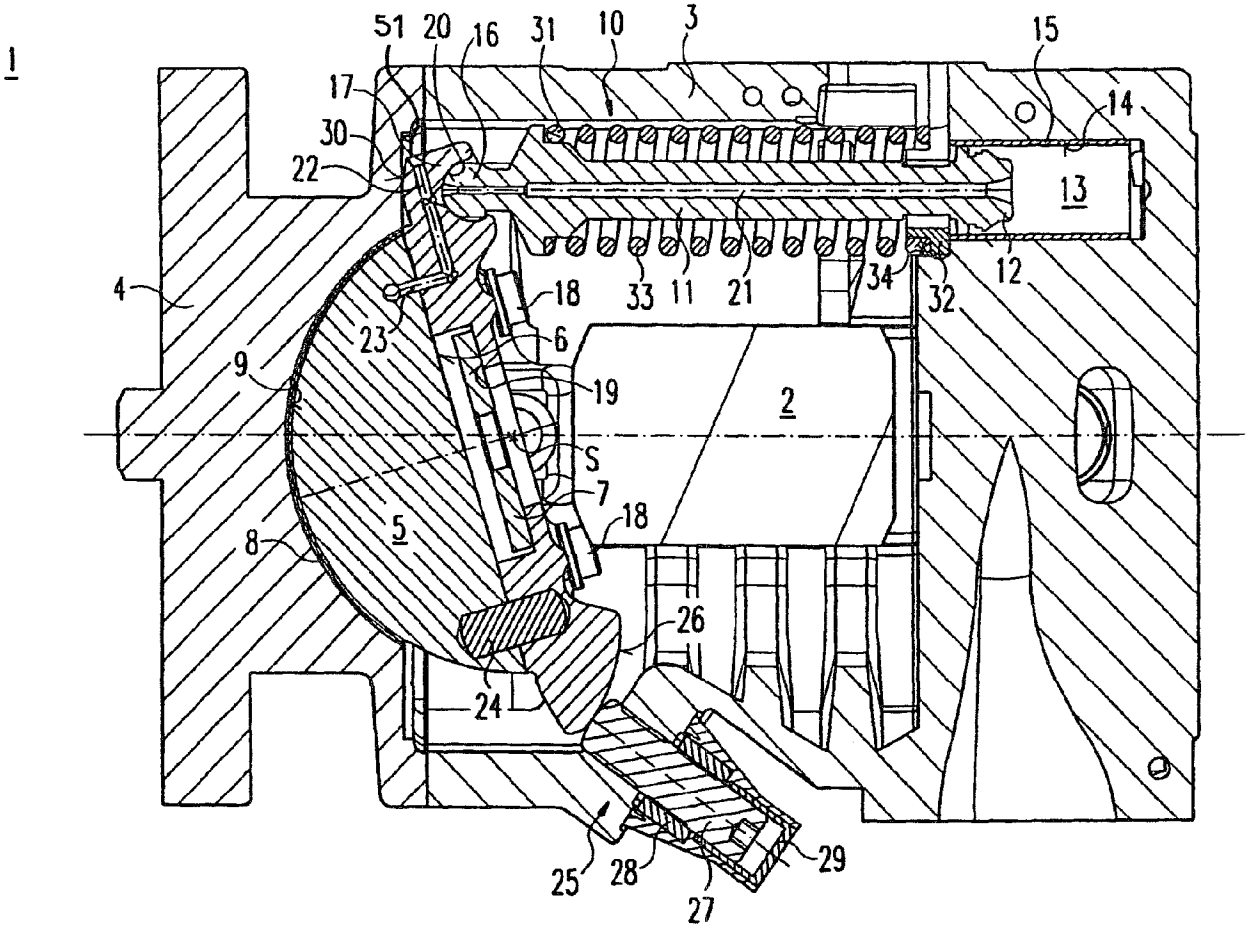
FIG. 1 shows a longitudinal section through an axial piston machine without the re-establishment of the adjusted displacement volume.

FIG. 1 shows a sectional illustration of an axial piston machine 1, wherein the sectional plane extends in parallel with an axis of rotation of the axial piston machine 1, but off-centre. The axial piston machine 1 comprises a cylinder drum 2 in which several cylinder bores are disposed distributed over a peripheral circle in a manner not shown. Pistons are disposed in the cylinder bores in a longitudinally displaceable manner and deliver a pressure medium by way of their stroke movement when the illustrated axial piston machine 1 is a pump.

The axial piston machine 1 comprises a housing which consists of a first cup-shaped housing part 3 and a second housing part which is formed as a flange part 4. A drive shaft which cannot be seen in FIG. 1 is mounted in a rotatable manner in the flange part 4 and the first cup-shaped housing part 3 and is connected in a rotationally-fixed manner to the cylinder drum 2. When the drive shaft rotates, the cylinder drum 2 is caused to rotate owing to the rotationally-fixed connection. The longitudinally displaceable pistons disposed in the cylinder drum 2 are supported in a known manner on a pivoting cradle 5 via slide shoes. For this purpose, the pivoting cradle 5 comprises a running surface 6. In order to prevent the slide shoes lifting from the running surface 6 of the pivoting cradle 5 during an intake stroke, a recoil plate 7 is provided. The recoil plate 7 is kept at a fixed distance from the running surface 6 of the pivoting cradle 5 and thus prevents the slide shoes lifting from the running surface 6. In order to permit a rotational movement of the pivoting cradle 5, the slide shoes are connected to the pistons in an articulated manner. In dependence upon the inclined position of the pivoting cradle 5, the pistons in the cylinder drum 2 thus carry out a stroke of a different size per rotation of the drive shaft or cylinder drum 2.

Figure 5:
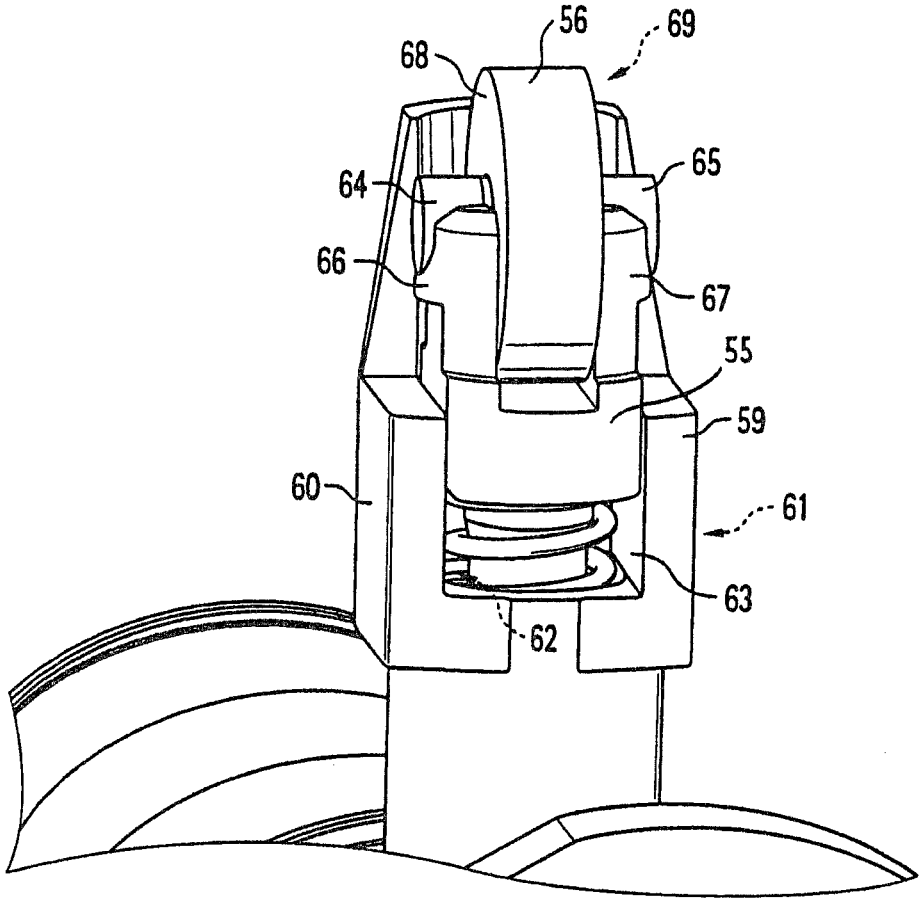
FIG. 5 shows a perspective illustration of a part of the return device of FIG. 3.

On its side facing the flange part 4, the pivoting cradle 5 comprises a pivoting cradle bearing 8. For this purpose, at least one first bearing region is formed on the pivoting cradle 5 and forms a slide bearing with a corresponding recess 9 in the flange part 4. The formation of the pivoting angle bearing of the pivoting cradle 5 will be explained further hereinafter with reference to FIGS. 2 and 5.

The pivoting cradle 5 can be rotated about a pivot axis S by turning the pivoting cradle 5 in the pivoting cradle bearing. The tilt of the running surface 6 relative to the axis of rotation of the cylinder drum 2 thereby changes.

In order to adjust the tilt of the pivoting cradle 5 and thus the stroke of the pistons in the cylinder drum 2 during a rotation of the cylinder drum 2, an adjustment system is provided within the housing of the axial piston machine 1. The adjustment system includes at least one first adjustment device 10. The first adjustment device 10 comprises a first adjustment piston 11. The first adjustment piston 11 defines a pressure chamber 13 with its first end 12. The pressure chamber 13 is formed in a base of the cup-shaped housing part 2. In order to form the pressure chamber 13, a blind bore 14 is incorporated in the base of the cup-shaped housing part 3 and a sleeve 15 is inserted therein. The sleeve 15 is preferably pressed into the blind bore 14. The inner wall of the sleeve 15 is used as a slide surface for the first end 12 of the adjustment piston 11 and co-operates in a sealing manner with the first end 12 of the first adjustment piston 11. The first end 12 of the adjustment piston 11 is not formed in a cylindrical manner but rather has a slightly crowned shape in order to prevent tipping in the sleeve 15 when the adjustment piston 11 is in an inclined position relative to the longitudinal axis of the sleeve 15. A sealing ring could also be disposed in the crown-shaped region of the first end 12 of the adjustment piston 11.

A spherical head is formed on a second end 16 of the adjustment piston 12 remote from the first end 12. The spherical head is connected to a retaining segment 17 such that tractive forces and also compressive forces can be transferred. The retaining segment 17 is fixedly connected to the pivoting cradle 5 by means of screws. The retaining segment 17 is screwed onto the running surface 6 in an outer region of the pivoting cradle 5. The retaining segment 17 also comprises a retaining surface 19 which engages over the recoil plate 7 and lies against the recoil plate 7 and thus ensures that the recoil plate 7 is kept at a constant distance from the running surface 6 of the pivoting cradle 5.

In order to attach the spherical head-shaped second end 16 of the adjustment piston 11, a spherical recess 20 is provided in the retaining segment 17 and encloses the spherical head-shaped second end 16 of the adjustment piston 11. The connection of the adjustment piston 11 to the retaining segment 17 is designed as a locked connection, i.e., the spherical head-shaped second end 16 is enclosed by the spherical recess of the retaining segment further than the equator.

A lubricant channel 21 is formed within the adjustment piston 11 in the first adjustment device 10. The lubricant channel 21 extends from the first end 12 of the adjustment piston 11 to the second end 16. The lubricant channel 21 thus connects the pressure chamber 13 to the spherical head-shaped second end 16 of the adjustment piston 11. A pressure prevailing in the pressure chamber 13 is thus sufficient for discharging pressure medium at the spherical head-shaped second end 16 of the adjustment piston 11. The articulated connection between the adjustment piston 11 and the retaining segment 17 is thus lubricated and hydrostatically relieved.

It may be assumed in FIG. 1 that the first adjustment device 10 is provided for pivoting the axial piston machine 1 in the maximum displacement volume direction. The pressure chamber 13 is connected for this purpose to the conveying side of the axial piston machine 1 designed as a pump. The high pressure present in the pressure chamber 13 is further used in order to hydrostatically relieve the pivoting cradle 5 in the flange part 4. For this purpose a pressure medium channel 22 and 23 is formed in the retaining segment 17 and also in the pivoting cradle 5 respectively. The pressure medium channel 23 of the pivoting cradle 5 is connected to the bearing region 8 outside the sectional view illustrated in FIG. 1 in a manner not shown. The pressurised pressure medium originating from the pressure chamber 13 is thus discharged between the recess 9 and the bearing region 8 of the pivoting cradle 5 and is thus sufficient for hydrostatically relieving the pivoting cradle 5. This results in a considerable reduction of the necessary actuation forces.

In order to enable positioning of the retaining segment 17 relative to the pivoting cradle 5, an alignment pin 24 is provided which is inserted into a bore in the pivoting cradle 5 and into a corresponding bore in the retaining segment 17. Furthermore, in the region of an end of the retaining segment 17 remote from the ball-and-socket joint connection between the adjustment piston 11 and the retaining segment 17, an adjustable first limiting device 25 is provided in the cup-shaped housing part 3. The first limiting device 25 co-operates with a first stop surface 26 which is formed on the retaining segment 17. The first stop surface 26 is designed to be crown-shaped which means that, independent of the adjustment of the first limiting device 25, the force is applied through the limiting device 25 to the first stop surface 26 in a perpendicular manner and thus through the centre point of the crowning. The centre point of this crowning is located in the direction of the pivoting cradle 5 as viewed from the stop surface.

The first limiting device 25 includes an adjusting screw 27 which is screwed into a housing bore in a thread provided for that purpose. In dependence upon the screw-in depth, the maximum deflection of the pivoting cradle 5 in a first direction of movement is fixed by the first limiting device 25. The housing bore is disposed in the region of the boundary surface of the cup-shaped housing part 3. It forms, with the axis of rotation, an angle such that the centre axis of the adjusting screw 27 extends through the centre point of the crowning of the stop surface 26.

The first adjustment device 10, the first limiting device 25 and the first retaining segment 17 are all assigned to a first direction of movement of the pivoting cradle 5. Whilst the first adjustment device 10 attempts to displace the pivoting cradle 5 in a first direction of movement, the first limiting device 25 is used as an adjustable stop and thus defines the maximum displacement in this first direction of movement. In order to keep the adjusting screw 27 in a selected position, a counternut 28 is provided. The counternut 28 is simultaneously used to seal the housing interior with respect to the surrounding area. A safety cap 29 prevents unauthorised changing of the adjustment values.

In order always to ensure the safety of the axial piston machine 1, even in the case of an inadvertent displacement of the adjusting screw 27, a further stop surface 30 is also formed on the same end of the retaining segment 17 on which the ball-and-socket connection between the second end 16 of the adjustment piston 11 and the first retaining segment 17 exists. The further stop surface 30 is formed on the side facing the flange part 4 and co-operates with a counterpart 51 of the flange part 4 to form a safety stop. Therefore, even when the adjusting screw 27 is completely screwed out, displacement can occur merely until contact with the safety stop.

During displacement of the axial piston machine 1 in the maximum stroke volume direction, the safety stop is preferably formed between the flange part 4 and the further stop surface 30 of the first retaining segment 17.

The first adjustment device 10 and the first limiting device 25 are, as can be seen directly from FIG. 1, disposed in a plane which extends in parallel with the axis of rotation of the cylinder drum 2 and in particular perpendicular to the pivot axis S of the pivoting cradle 5. The force direction for introducing the adjustment force through the first adjustment device 10 and also the force direction when stopping against the adjustable first limiting device 25 are thus also in the plane formed in parallel with the axis of rotation. Since this plane extends simultaneously through a first bearing region formed on the pivoting cradle 5 and the flange part 4, torsional forces on the pivoting cradle 5 are obviated.

In order to bias the axial piston machine 1 in the maximum displacement volume direction, even in the event of the pressure chamber 13 having no pressure, a resilient element is provided on the first adjustment device 10. The resilient element is designed as a spring 33 in the illustrated exemplified embodiment. The spring 33, which is preferably a steel helical spring, is supported on the one hand on a first spring bearing 31 formed in the proximity of the second end 16. The spring bearing 31 is formed as a radial shoulder in the adjustment piston 11 and comprises a guide section for centring the spring 33, said guide section extending in the axial direction slightly in the direction of the first end 12 of the adjustment piston 11. On the opposite end of the spring 33, the spring 33 lies against a second spring bearing 32. The spring bearing 32 also comprises a guide section which extends in the axial direction. The spring bearing 32 is disposed in a centring recess 34 of the housing part 3 and at that location lies against the base of the cup-shaped housing part 3. The spring bearing 32 preferably simultaneously lies against the base of the cup-shaped housing 3 at the bottom of the centring recess 34 and against the end of the sleeve 15 oriented towards the interior of the housing of the axial piston machine 1. Alternatively, the spring can also be disposed at another location on the adjustment system, in particular on a second adjustment device which is still to be described.

FIG. 1 illustrates a sectional view [of the] the plane defined by the first adjustment device 10 and the first adjustable limiting device 25. The first adjustment device 10 is provided for displacing the axial piston machine 1 in the larger stroke volume direction and can thus be referred to as a pivoting device. This is the case when the axial piston machine 1 is used as a hydraulic pump e.g., in the open circuit and is provided for the purposes of delivery in only one direction.

In the axial piston machine 1 a second adjustment device 35 is also provided which, however, cannot be seen in the illustration of FIG. 1 because of the placement of the cross-sectioning. The second adjustment device 35 also has a second variable limiting device 39 and corresponds substantially to the first adjustment device 10. The second adjustment device 35 and the second limiting device 39 are also in turn disposed in a common plane, wherein this further plane lies in parallel with the plane of the first adjustment device 10 and of the first limiting device 25. Both planes preferably lie symmetrically to the axis of rotation of the cylinder drum 2.

Figure 2:
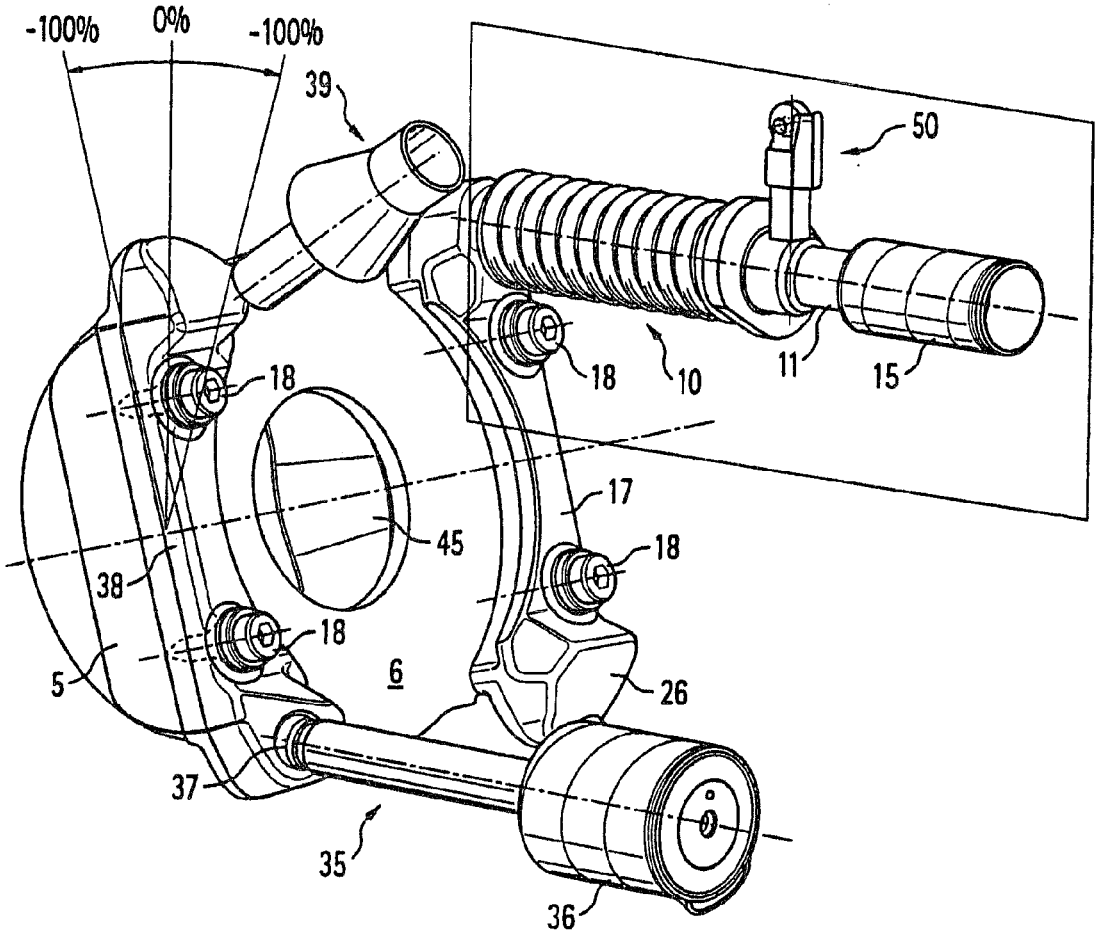
FIG. 2 shows an illustration of the essential components of an adjustment system of an axial piston machine with the re-establishment of the adjusted position of the pivoting cradle.

This arrangement is shown in FIG. 2, in which the individual components of the adjustment system are again shown in a perspective view. Thus, for the sake of easier understanding, the components of the axial piston machine 1 not relevant to the adjustment system have been left out. In the adjustment system illustrated in FIG. 2, the return device in accordance with the invention is also shown. This will be further explained hereinafter.

It is to be noted that the first adjustment device 10 and the second adjustment device 35 lie on opposite sides with respect to the axis of rotation. The second adjustment device 35 of the adjustment system also has an adjustment piston which is mounted with its first end in a second sleeve 36. The second sleeve 36 is also inserted in a blind bore in the base of the cup-shaped housing part 3. Therefore a second pressure chamber is formed in the sleeve 36, which is closed by the base of the cup-shaped housing part 3 as in the case of the first adjustment device 10. The pressure chamber(s) is/are defined by a similarly crown-shaped adjustment piston disc. Over the whole displacement path of the adjustment system the respectively crown-shaped adjustment piston disc of both the adjustment piston 11 and also of the adjustment piston of the second adjustment device 35 is guided in the sleeve 15 and/or the further sleeve 36. At the other end of the adjustment piston of the second adjustment device 35 a ball-and-socket joint connection is also formed. The second end 37 of the adjustment piston of the second adjustment device 35 is also inserted into a spherical recess in a second retaining segment 38. The second retaining segment 38 is connected, like the first retaining segment 17, to the pivoting cradle 5 by means of screws 18. The first and the second retaining segment 17 and 38 are preferably identical in formation. The first retaining segment 17 extends substantially along the plane in which the first adjustment device 10 and the first limiting device 25 are disposed. In a corresponding manner the second retaining segment 38 extends substantially along a further plane in which the second adjustment device 35 and a second variable limiting device 39 are disposed. The second variable limiting device 39 corresponds in construction to the first variable limiting device 25 so that another description will not be given. In dependence upon, for example, different conveying amounts in one or the other direction, the adjusting screw 27 for the first direction of movement can be selected to have a different length than for the second direction of movement.

The illustration of FIG. 2 shows that a connecting line between the first adjustment piston 11 and the adjustment piston of the second adjustment device 35 intersects the axis of rotation of the drive shaft. Likewise, a further imaginary connecting line of the two stop surfaces 26 and 40 intersects the axis of rotation. The two imaginary connecting lines for their part form an angle of approximately 70° to 90°. If a cross-section through the axial piston machine 1, which typically comprises a housing with a rectangular or square cross-section, is considered, the adjustment devices 10 and 35 are disposed on a first diagonal in the region of the inner corners of the housing and the adjustable limiting devices 25 and 39 are disposed on a second diagonal in the region of the inner corners of the housing. If, in such a cross-section, the axial piston machines are divided into 4 quadrants, then the first adjustment device 10 is disposed in the first quadrant, the first limiting device 25 is disposed in the fourth quadrant, the second adjustment device 35 is disposed in the third quadrant and the second adjustable limiting device 39 is disposed in the second quadrant.

On the second retaining segment 38 a stop surface 40 is also formed, which is crown-shaped. As in the case of the first retaining segment 30, the crown-shaped formation of the stop surface 40 ensures that force is always introduced perpendicular to the stop surface 40 regardless of the selected adjustment of the variable limiting device 39. In order to form a safety stop a further stop surface 41 is also formed on the second retaining segment 38. The further stop surface 41 is formed on the same end of the second retaining segment 38 as the ball-and-socket joint connection to the adjustment piston of the second adjustment device 35.

The pivoting cradle bearing 8 of the pivoting cradle 5 is formed by a first bearing surface and a second bearing surface. The first bearing surface extends over a width in the direction of the pivot axis S so that the plane in which the first adjustment device 10 and the first adjustable limiting device 25 are disposed, i.e., in which the force directions through the first adjustment device 10 and the first adjustable limiting device 25 lie, extends through the first bearing surface. In a corresponding manner, the second bearing surface also extends over a width in the direction of the pivot axis S so that the further plane, in which the second adjustment device 35 and the second limiting device 39 are disposed, extends through the region of the second bearing surface.

Figure 3:
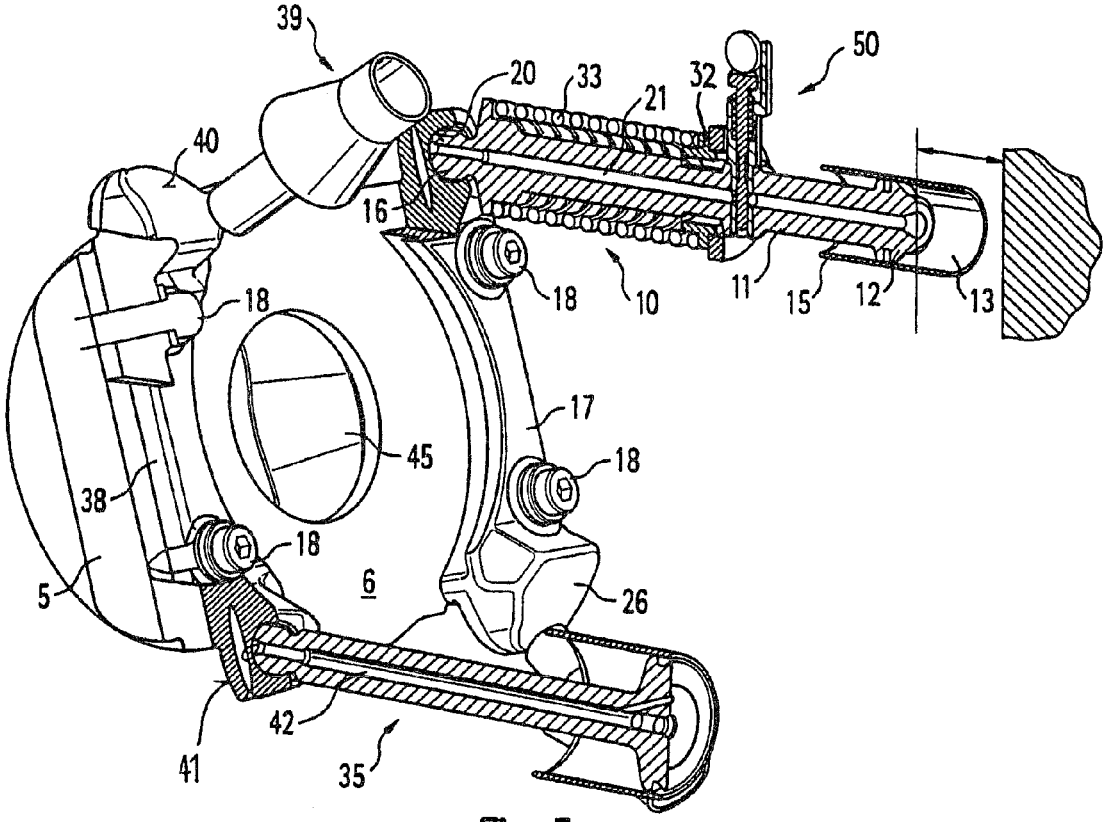
FIG. 3 shows a partial sectional illustration of an adjustment system having the return device in accordance with the invention.

The first adjustment device 10 and the second adjustment device 35 are illustrated in a sectional view in FIG. 3. It can be seen in the sectional illustration of the second adjustment device 35 that a lubricant channel 42 extending in the longitudinal direction is also provided in the adjustment piston of the second adjustment device 35. This lubricant channel 42 connects the second pressure chamber formed in the second sleeve 36 to the ball-and-socket joint connection between the adjustment piston and the second retaining segment 38.

It can be clearly seen in FIG. 3 that the first pressure chamber 13 has a smaller diameter than the second pressure chamber. As a result it is possible to allow the conveying-side high pressure of the axial piston machine 1 formed as a pump to always prevail in the first pressure chamber 13. A deviation in the decreasing conveying volumes direction is effected when the corresponding adjustment pressures in the second pressure chamber of the adjustment piston of the second adjustment device 35 are achieved.

It can be further seen that the pivoting cradle 5 has a bore 45 passing through the centre thereof. This bore 45 forms a passage for the drive shaft of the axial piston machine 1.

The adjustment piston 11 is a component of a return system. Such a return system is used in returning control arrangements for detecting a path signal and pressure signal. A return element 50 is provided for this purpose as a further component of the return device on the first adjustment piston 11 which corresponds to the pivoting piston for increasing the conveying volume in a pump provided for an open circuit.

Details regarding the return element 50 will be explained hereinafter now with reference to FIG. 4. The return element 50 is fixedly connected to the adjustment piston 11 and is supported in a planar manner on the outer periphery thereof. The return element 50, which is at an angle of 90°, thus provides, by way of its relative position with respect to the housing of the axial piston machine 1, information regarding the relative position of the adjustment piston 11 and thus also regarding the adjusted conveying volume. For example, it is necessary for power control systems to detect the adjusted conveying volume in conjunction with the conveying-side pressure. This conveying pressure is, as already explained above with reference to FIG. 1, supplied to the pressure chamber 13 and thus also prevails in the lubricant channel 21 of the adjustment piston 11.

The return element 50 acts upon a control device provided on the housing side, wherein a force dependent on the conveying pressure is produced by the return element on the control device in a position dependent on the adjusted conveying volume.

A pivot angle limitation which acts upon the adjustment piston 11 can also be provided on the first adjustment device 10. This pivot angle limitation is provided in the pressure chamber or at the base of the cup-shaped housing part 3 and limits the travel of the adjustment piston 11. The pivot angle limitation is adjusted, in the case of a pump provided for the purposes of delivery in only one direction with a maximum conveying volume in this direction, from 100% to preferably −10%. The adjustment is effected constructively, i.e., by fixing the maximum travel of the adjustment piston 11 in the sleeve 15 with respect to the bottom of the blind bore 14 before the return element 50 arrives at the edge of the sleeve 15. This is schematically illustrated in FIG. 4. A fixed pivot angle limitation in this manner preferably replaces the already described safety stop of the second adjustment unit.

Figure 4:
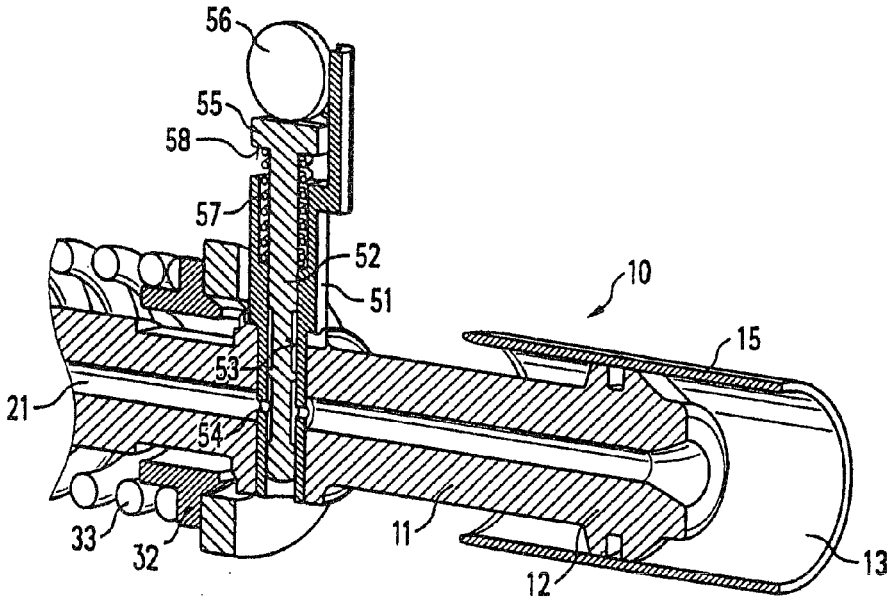
FIG. 4 shows an enlarged illustration of a return element of the return device of FIG. 3.

FIG. 4 shows that the return element 50 comprises for this an adjustment sleeve 51 and a measuring piston 52 disposed partly therein. Whilst the adjustment sleeve 51 is sufficient for correctly positioning the return element, a force corresponding to the pressure in the pressure chamber 13 is produced by the measuring piston 52. The adjustment sleeve 51 is inserted into a transverse bore formed perpendicular to the longitudinal axis of the adjustment piston 11.

For this purpose, the measuring piston 52 comprises a radial graduation. As a result, two differently sized annular surfaces are produced on the measuring piston 52 together with the correspondingly graduated measuring piston receiving bore 53 of the adjustment sleeve 51. These two annular surfaces are oriented in opposite directions to each other which means that a resulting force, which is dependent upon the conveying pressure of the axial piston machine 1, is produced on the measuring piston 52.

The adjustment sleeve 51 passes through the adjustment piston 11 and thus the lubricating oil channel 21 in the transverse direction. In order to connect the sections of the lubricating oil channel 21 which are initially separate from each other in this manner, a connecting bore 54 is formed as a pressure medium passage in the adjustment sleeve 51 in the region of the lubricating oil channel 21.

The measuring piston 53 tapers radially in the region of the connecting bore 54 which means that pressure medium can flow via the thus produced annular channel from one section of the lubricating oil channel 21 into the other section of the lubricating oil channel 21. The regions of the measuring piston 52 formed on both sides of the radial taper co-operate with the receiving bore 53 of the adjustment sleeve 51 in a sealing manner and in order to guide the measuring piston 52. In order to supply the pressure medium to the oppositely oriented annular surfaces, at least one flattened region is, however, provided at the diameter of the centre guide region of the measuring piston 52 in the adjustment sleeve 51 at the region oriented towards the force-transferring end 55. An overflow channel is formed by this flattened region. The centre guide region of the measuring piston in the adjustment sleeve could also be excluded.

At the force-transferring end 55 a roller 56 is connected to the measuring piston 52. The roller is oriented such that it rolls, when the position of the adjustment piston 11 changes, on the counter surface to which the force is transferred. The rolling direction coincides with the direction of movement of the adjustment piston 11 in the case of an adjustment movement.

In order to always keep the roller 56 bearing against the counter surface independently of the just produced hydraulic force, a bias spring 57 is inserted into a widened region of the graduated receiving bore 53 of the adjustment sleeve 51. The bias spring 57 is supported on the one hand on a second step of the graduated receiving bore 53 and on the other hand on a collar 58 of the measuring piston 52. However, the bias spring 57 could also be excluded.

In order to prevent the return element 50 from turning or to always keep the rolling direction in the direction of movement of the adjustment piston 11, a guide section 59 is formed on the adjustment sleeve 51 at its end remote from the adjustment piston 11. Two planar surfaces 60, 61 are formed on the guide section 59 and are directed outwardly in opposite directions and engage into a corresponding recess of the cup-shaped housing part 3. The width of the corresponding recess is dimensioned such that the return element is guided with a small amount of clearance and it is not possible for the return element 50 to turn.

In addition, second further guide surfaces 62, 63 facing each other are formed on the guide section 59. The force-transferring end 55 of the measuring piston 52 is disposed in the region of the guide surfaces 62, 63. The width of the force-transferring end 55 of the measuring piston 52 is selected such that the measuring piston is guided with a small amount of clearance and the guide section 59 prevents the measuring piston 52 from turning.

Spigots 64, 65 are formed on both sides of the roller 56 and the two spigots 64, 65 are preferably formed in one piece with the roller 56. The force-transferring end 55 is bifurcated, wherein spigot bearings are formed in the two thus produced limbs 66, 67. The spigot bearings produce, together with the two spigots, a locked connection of the roller 56 on the measuring piston 52. The two spigot bearings enclose the spigots by more than 180° which means that the roller can no longer fall out therefrom in the unloaded condition.

In order to guide the roller 56 between the two limbs 66, 67, the two lateral surfaces 68 and 69 of the roller 56 which are directed towards the spigots 64, 65 are designed to be conical or convex. Guiding and centring are thus achieved in the region of the lateral surfaces 68, 69 in proximity to the spigots, whilst the remaining region of the lateral surfaces does not contact the limbs 66, 67. The frictional forces can thus be reduced.

The invention is not limited to the illustrated exemplified embodiments. In particular it is possible to combine individual features of the illustrated exemplified embodiments with each other in an advantageous manner.

The invention claimed is:

1. An axial piston machine comprising:

a pivoting cradle having alterable inclination, at least one adjustment device extending substantially in the longitudinal direction of the axial piston machine, the at least one adjustment device comprising an adjustment piston for displacing the pivoting cradle, and a return element being adapted to provide information regarding the relative position of the adjustment piston and, accordingly, the relative position of the pivoting cradle, and to provide information regarding the adjusted conveying volume, by way of the relative position of the return element with respect to a housing of the axial piston machine and by acting upon a control device provided on the housing side, wherein the return element and the adjustment device are disposed in a plane which extends in parallel with an axis of rotation of the axial piston machine and perpendicular to a pivot axis of the pivoting cradle.

2. The axial piston machine as claimed in claim 1, wherein the return element divides a lubricating oil channel of the adjustment piston of the adjustment device into two sections which are connected to each other via the return element.

3. The axial piston machine as claimed in claim 1, wherein the return element comprises a measuring piston which is influenced by a pressure supplied via the return element.

4. The axial piston machine as claimed in claim 1, wherein the return element comprises an adjustment sleeve which is guided in a housing recess to prevent rotation.

5. The axial piston machine as claimed in claim 1, wherein the return element comprises an adjustment sleeve and a measuring piston guided in the adjustment sleeve, and wherein the measuring piston is guided via a planar anti-rotation member in the adjustment sleeve.

6. The axial piston machine as claimed in claim 1, wherein the adjustment device comprises an adjustment piston having a crown-shaped adjustment piston disc disposed in a pressure chamber, and the return element is disposed between the crown-shaped adjustment piston disc and a bearing ring for supporting a bias spring on the adjustment piston.

7. The axial piston machine as claimed in claim 1, wherein a roller for transferring the force to a control device is provided on the return element, and the roller has conical or convex lateral surfaces.

8. The axial piston machine as claimed in claim 1, wherein the return element is disposed on the adjustment piston.

* * * * *